US008653929B2

(12) United States Patent
Xu

(10) Patent No.: US 8,653,929 B2
(45) Date of Patent: Feb. 18, 2014

(54) STEREO-TRIANGULAR WOUND-CORE POWER TRANSFORMER WITH A VOLTAGE CLASS MORE THAN OR EQUAL TO 110KV

(75) Inventor: Kaixuan Xu, Kaiping (CN)

(73) Assignee: Guangdong Hai Hong Co., Ltd., Kaiping, Guangdong (CN)

( * ) Notice: Subject to any disclaimer, the term of this patent is extended or adjusted under 35 U.S.C. 154(b) by 0 days.

(21) Appl. No.: 13/700,719

(22) PCT Filed: May 25, 2011

(86) PCT No.: PCT/CN2011/074630

§ 371 (c)(1), (2), (4) Date: Dec. 18, 2012

(87) PCT Pub. No.: WO2011/147310

PCT Pub. Date: Dec. 1, 2011

(65) Prior Publication Data

US 2013/0093559 A1 Apr. 18, 2013

(30) Foreign Application Priority Data

May 28, 2010 (CN) ..... 2010 2 0213476 U

(51) Int. Cl.

| | |
|---|---|
| ***H01F 27/26*** | (2006.01) |
| ***H01F 27/28*** | (2006.01) |
| ***H01F 17/04*** | (2006.01) |
| ***H01F 30/12*** | (2006.01) |

(52) U.S. Cl.

USPC ..... 336/210; 336/170; 336/221; 336/5

(58) Field of Classification Search

USPC ..... 336/210, 170, 220, 221, 222, 5, 145, 336/198, 107, 229

See application file for complete search history.

(56) References Cited

U.S. PATENT DOCUMENTS

| | | | | |
|---|---|---|---|---|
| 3,815,068 | A * | 6/1974 | Hori et al. | 336/100 |
| 4,247,841 | A * | 1/1981 | Nakatake et al. | 336/150 |
| 6,683,524 | B1 * | 1/2004 | Hoglund | 336/213 |
| 6,809,620 | B2 * | 10/2004 | Hoglund | 336/5 |
| 8,373,529 | B2 * | 2/2013 | Hurst et al. | 336/5 |

FOREIGN PATENT DOCUMENTS

| | | | |
|---|---|---|---|
| CN | 2053372 | U | 2/1990 |
| CN | 101236824 | A * | 12/2007 |
| CN | 201072688 | Y | 6/2008 |
| CN | 101236824 | A | 8/2008 |
| CN | 201259817 | Y | 6/2009 |
| CN | 201741535 | U | 2/2011 |

* cited by examiner

*Primary Examiner* — Alexander Talpalatski
*Assistant Examiner* — Kazi Hossain
(74) *Attorney, Agent, or Firm* — Rahman LLC

(57) ABSTRACT

A stereo-triangular wound-core power transformer with a voltage class more than or equal to 110 kV is disclosed, which includes a stereo-triangle wound-core and windings, wherein the core includes iron yokes and core pillars which are arranged in a stereo-triangle shape, with every two adjacent core pillars connected through an iron yoke. The power transformer further includes angle rings, end rings, insulating end rings, insulating end plates and a frame-type clamp, wherein the angle rings, insulating end rings, end rings and insulating end rings are arranged at both ends of the core pillars in sequence, respectively, and the ends of the core pillars are arranged on the insulating end plates. The frame-type clamp covers the iron yokes, and the supporting boards of the frame-type clamp are connected with the insulating end plates through pressing screws.

2 Claims, 2 Drawing Sheets

STEREO-TRIANGULAR WOUND-CORE POWER TRANSFORMER WITH A VOLTAGE CLASS MORE THAN OR EQUAL TO 110KV

TECHNICAL FIELD

The invention is in the field of power equipment, and particularly relates to a stereo-triangular wound-core power transformer with a voltage class more than or equal to 110 kV.

BACKGROUND

Nowadays, laminated cores have been adopted in the power transformers with a voltage class of 110 kV or above. A laminated core is formed from shaped silicon steel sheets which are processed in slitting and shearing production lines and laminated. The major disadvantages of the laminated core include: firstly, there are many air gaps formed by the seams in the magnetic circuits, causing greater magnetic resistance and consequently larger no-load loss and no-load current; secondly, the direction of the local magnetic circuits is not in conformity with the high magnetic direction of the silicon steel sheets; thirdly, the sheets are not close enough, this not only reduces the lamination factor, but also increases the noise; fourthly, the three phase currents are not balanced due to unbalanced three-phase magnetic circuits. To sum up, the laminated core power transformers have some obvious defects, and therefore there is a need for those skilled in the art to improve these power transformers.

SUMMARY OF THE INVENTION

The aim of this invention is to provide a type of safe, reliable, and energy and material saving stereo-triangular wound-core power transformers with a voltage class up to 110 kV or above, with a reasonable structure, balanced three phases and lower noise.

The invention is achieved through a stereo-triangular wound-core power transformer with a voltage class up to 110 kV or above, which comprises a stereo wound-core and windings. The transformer is characterized in that: the stereo-triangular wound-core comprises iron yokes and core pillars, wherein three core pillars are arranged in a regular triangle shape, with each two adjacent core pillars connected through an iron yoke.

The windings comprise high-voltage windings and low-voltage windings, or a regulating winding; the high-voltage windings and low-voltage windings are wound on the core pillars, and the regulating winding is wound on a core pillar as well.

The transformer further comprises angle rings, end rings, insulating end rings, insulating end plates and a frame-type clamp, wherein the angle rings, insulating end rings, end rings and insulating end rings are arranged in sequence at the two ends of each core pillar respectively, the ends of the core pillars are arranged on the insulating end plates, the high-voltage windings, low-voltage windings and regulating winding are arranged on the core pillars between the angle rings; the three core pillars extend through the insulating end plates respectively; the frame-type clamp covers the iron yokes, and supporting plates are provided on the frame-type clamp and connected with the insulating end plates through pressing screws.

The transformer further comprises insulating cylinders and supporting strips. The insulating cylinders envelope the high-voltage windings, low-voltage windings, and regulating winding; and the supporting strips are arranged between every two adjacent insulating cylinders, and the gap between the insulating cylinder and two adjacent supporting strips forms an oil duct.

The stereo-triangular wound-core comprises three identical single frames which are pieced together and arranged in a regular triangle shape; the cross section of the core pillars is in a quasi-circular shape.

Second strips, padding blocks and an oil baffle are provided on the windings; the padding blocks are arranged at both ends of the windings wound on the core pillars, and the second strips are arranged on the windings between every two padding blocks.

The second strips are matched with the insulating cylinder and windings. The stereo-triangular wound-core power transformer with a voltage class more than or equal to 110 kV provided in the invention employs a stereo-triangular wound-core structure, wherein the stereo-triangular wound-core comprises three identical single frames pieced together, of which three core pillars are arranged in a regular triangle shape. This arrangement guarantees the balance of the three phases, and greatly reduces the magnetic resistance, excited current and no-load loss. Every single frame is wound by several trapezium strips continuously in sequence, the silicon steel strips are wound tightly, and the magnetic conduction direction of the silicon steel strips is in line with the magnetic circuit direction of the core. The vibration during operation is small, and the noise caused by laminated core magnetic circuit incoherence is reduced. The cross section of the single frames is in an approximately semicircular shape, and thus the cross section of them after pieced is in a quasi-polygon shape which is very close to a circle, as shown in FIG. 3. The trapezium strips with difference sizes wound for the single frames are cut by dedicated slitting machines, such a slitting method can provide a non-scrap processing; in other words, the utilization rate of material is 100%.

DESCRIPTION OF EMBODIMENTS

Figure 1:
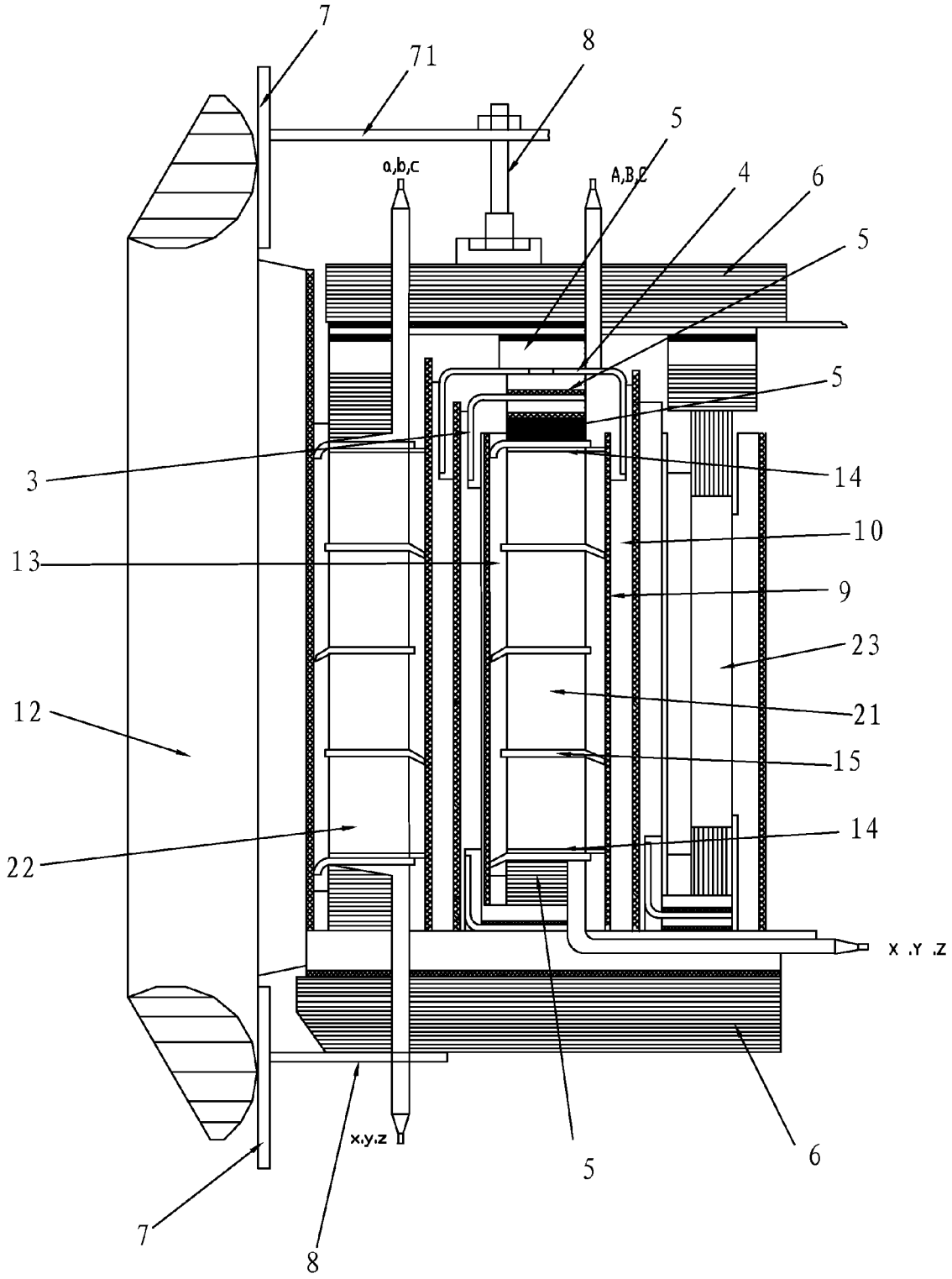
FIG. 1 is a cross sectional view of a transformer according to the invention.
Figure 2:
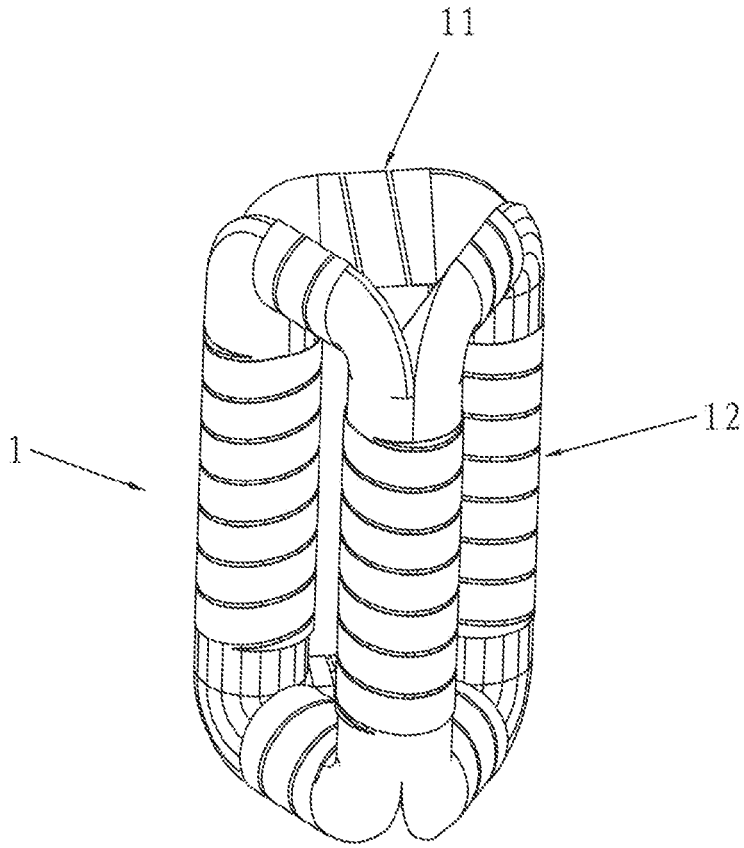
FIG. 2 is a perspective view of the stereo-triangle wound-core of the transformer according to the invention.

As shown in FIGS. 1 and 2, the stereo-triangle wound-core power transformer with a voltage class more than or equal to 110 kv comprises a stereo-triangle wound-core and windings; as shown in FIG. 2, the stereo-triangle wound-core 1 comprises iron yokes 11 and core pillars 12, wherein three core pillars 12 are arranged in a regular triangle shape, and every two adjacent core pillars 12 are connected by an iron yoke 11.

The windings include high-voltage windings 21 and low-voltage windings 22, and/or a regulating winding 23. The high-voltage windings 21 and low-voltage windings 22 are wound on the core pillars 12, and the regulating winding 23 is wound on a core pillar 12 as well.

The transformer further comprises angle rings 3, end rings 4, insulating end rings 5, insulating end plates 6 and a frame-type clamp 7.

At both ends of the core pillars, the angle rings 3, insulating end rings 5, end rings 4 and insulating end rings 5 are arranged in sequence, respectively; and the ends of the core pillars 12 are provided with insulating end plates 6. The high-voltage windings 21, low-voltage windings 22 and regulating winding 23 are arranged on the core pillars 12 between the angle rings 3, and the three core pillars 12 extend through the insulating end plates 6, respectively. The frame-type clamp 7 covers the iron yokes 11, and the supporting plates 71 of the frame-type clamp 7 are connected with the insulating end plates 6 through pressing screws 8.

The transformer further comprises insulating cylinders 9 and supporting strips 10.

The insulating cylinders 9 enclose the high-voltage windings 21, low-voltage windings 22 and regulating winding 23. The supporting strips 10 are arranged between every two adjacent insulation cylinders 9, and the gaps between the insulating cylinder 9 and two adjacent supporting strips 10 form oil ducts.

As shown in FIG. 2, the stereo-triangle wound-core 1 comprises three identical single frames which are pieced together and arranged in a regular triangle shape.

Figure 3:
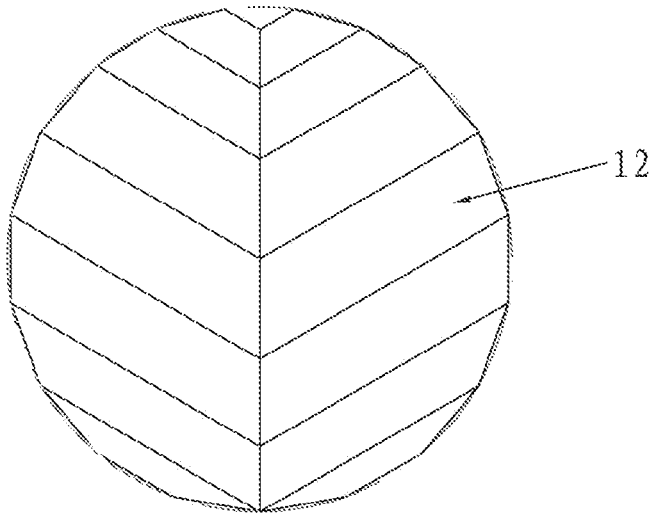
FIG. 3 is a cross sectional view of a core pillar of the stereo-triangle wound-core according to the invention.

As shown in FIG. 3, the cross section of the core pillars 12 is in a quasi-circular shape.

Second strips 13, padding blocks 14 and oil baffles 15 are provided on the windings. The padding blocks 14 are located at both ends of the windings on the core pillars 12, and the second strips 13 are located on the windings between two padding blocks 14.

The second strips 13 are matched with the insulating cylinders 9 and windings.

What is claimed is:

1. A stereo-triangular wound-core power transformer with a voltage class more than or equal to 110 kV, comprising a stereo-triangular wound-core and windings, characterized in that:

the stereo-triangular wound-core comprises iron yokes and core pillars which are arranged in a stereo-triangular shape with each two adjacent core pillars connected to each other by an iron yoke;

the windings comprise high-voltage windings and low-voltage windings, or a regulating winding; with the high-voltage and low-voltage windings wound on the core pillars, and the regulating winding wound on a core pillar as well;

the transformer further comprises angle rings, end rings, insulating end rings, insulating end plates and a frame-type clamp, wherein the angle rings, insulating end rings, end rings and insulating end rings are arranged in sequence at the two ends of each core pillar respectively, the ends of the core pillars are arranged on the insulating end plates, the high-voltage windings, low-voltage windings and regulating winding are arranged on the core pillars between the angle rings; the three core pillars extend through the insulating end plates respectively; and the frame-type clamp covers the iron yokes, and supporting plates are provided on the frame-type clamp and connected with the insulating end plates through pressing screws;

the transformer further comprises insulating cylinders and supporting strips;

the insulating cylinders enclose the high-voltage windings, low-voltage windings, and regulating winding; the supporting strips are arranged between every two adjacent insulating cylinders, and the gap between the insulating cylinder and two adjacent supporting strips forms an oil duct;

the stereo-triangular wound-core consists of three identical single frames which are pieced together and arranged in a regular triangle shape; and the cross section of the core pillars is in a quasi-circular shape, wherein every single frame is wound by several trapezium strips continuously in sequence, the trapezium strips are wound tightly, each frame is an integral and unified structure, and the magnetic conduction direction of the trapezium strips is in line with the magnetic circuit direction of the core.

2. The stereo-triangular wound-core power transformer with a voltage class more than or equal to 110 kV according to claim 1, characterized in that:

second strips, padding blocks and oil baffles are provided on the windings; the padding blocks are arranged at both ends of the windings wound on the core pillars, and the second strips are arranged on the windings between every two padding blocks; and the second strips are matched with the insulating cylinder and windings.

* * * * *